US006629568B2

(12) United States Patent
Post et al.

(10) Patent No.: US 6,629,568 B2
(45) Date of Patent: Oct. 7, 2003

(54) BI-DIRECTIONAL GRIP MECHANISM FOR A WIDE RANGE OF BORE SIZES

(75) Inventors: Roger A. Post, Arcanum, OH (US); Todor K. Sheiretov, Sugar Land, TX (US); Carl J. Roy, Richmond, TX (US); Joseph F. Cordera, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 194 days.

(21) Appl. No.: 09/921,825

(22) Filed: Aug. 3, 2001

(65) Prior Publication Data

US 2003/0024710 A1 Feb. 6, 2003

(51) Int. Cl.[7] ..... E21B 23/00

(52) U.S. Cl. ..... 166/382; 166/206; 166/216; 166/241.1

(58) Field of Search ..... 166/206–209, 166/213, 241.1–241.7, 381, 382

(56) References Cited

U.S. PATENT DOCUMENTS

| | | | |
|---|---|---|---|
| 1,177,984 | A | 4/1916 | Beene |
| 2,742,259 | A | 4/1956 | Boucher |
| 2,871,946 | A | 2/1959 | Bigelow |
| 3,405,772 | A | 10/1968 | Wisenbaker et al. |
| 3,670,566 | A | 6/1972 | Basham et al. |
| 3,827,512 | A | 8/1974 | Edmond |
| 3,862,359 | A | 1/1975 | McCullough et al. |
| 3,890,905 | A | 6/1975 | Clavin |
| 3,926,267 | A | 12/1975 | Svirschevsky et al. |
| 4,031,750 | A | 6/1977 | Youmans et al. |
| 4,050,384 | A | 9/1977 | Chapman |
| 4,071,086 | A | 1/1978 | Bennett |
| 4,095,655 | A | 6/1978 | Still |
| 4,112,850 | A | 9/1978 | Sigel-Gfeller |

(List continued on next page.)

FOREIGN PATENT DOCUMENTS

| | | |
|---|---|---|
| EP | 0564500 B1 | 10/1994 |
| EP | 0964131 A2 | 12/1999 |
| SU | 481748 | 9/1975 |
| WO | WO-95/21987 | 8/1995 |
| WO | WO-98/06927 | 2/1998 |
| WO | WO-99/66171 | 12/1999 |

*Primary Examiner*—David Bagnell
*Assistant Examiner*—Giovanna M Collins
(74) *Attorney, Agent, or Firm*—Wayne I. Kanak; Brigitte L. Jeffery; John J. Ryberg

(57) ABSTRACT

A linkage apparatus for selectively gripping and releasing the inside walls of a conduit, the apparatus comprising: a first arm; a bi-directional gripping cam rotatably attached to the arm; and an extension and locking device adapted to selectively radially extend the arm from a tool housing to an inside wall of a conduit and adapted to selectively lock the arm in an extended position.

23 Claims, 12 Drawing Sheets

U.S. PATENT DOCUMENTS 4,177,734 A 12/1979 Rhoden
4,192,380 A 3/1980 Smith
4,243,099 A 1/1981 Rodgers, Jr.
4,272,781 A 6/1981 Taguchi et al.
4,313,498 A * 2/1982 Anderson ..... 166/206
4,369,713 A 1/1983 Richardson
4,372,161 A 2/1983 de Buda et al.
4,457,236 A 7/1984 Akhmadiev et al.
4,460,920 A 7/1984 Weber et al.
4,463,814 A 8/1984 Horstmeyer et al.
4,537,136 A 8/1985 Douglas
4,557,327 A 12/1985 Kinley et al.
4,670,862 A 6/1987 Staron et al.
4,676,310 A 6/1987 Scherbatskoy et al.
4,686,653 A 8/1987 Staron et al.
4,838,170 A 6/1989 Illakowicz
4,862,808 A 9/1989 Hedgcoxe et al.
4,919,223 A 4/1990 Egger et al.
5,142,989 A 9/1992 Suzumori et al.
5,184,676 A 2/1993 Graham et al.
5,293,823 A 3/1994 Box
5,309,844 A 5/1994 Zollinger
5,358,039 A 10/1994 Fordham
5,375,530 A 12/1994 Zollinger et al.
5,375,668 A 12/1994 Hallundbaek
5,433,493 A * 7/1995 Dix et al. ..... 294/4
5,765,640 A * 6/1998 Milne et al. ..... 166/206
5,794,703 A 8/1998 Newman et al.
5,848,479 A 12/1998 MacIndoe
5,954,131 A 9/1999 Sallwasser
6,003,606 A 12/1999 Moore et al.
6,082,461 A 7/2000 Newman et al.
6,089,323 A 7/2000 Newman et al.
6,112,809 A 9/2000 Angle
6,179,055 B1 1/2001 Sallwasser et al.
6,232,773 B1 5/2001 Jacobs et al.
6,241,031 B1 6/2001 Beaufort et al.
6,273,189 B1 8/2001 Gissler et al.
6,427,786 B2 8/2002 Beaufort et al.
6,478,097 B2 11/2002 Bloom et al.

* cited by examiner

Section A-A

BI-DIRECTIONAL GRIP MECHANISM FOR A WIDE RANGE OF BORE SIZES

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF INVENTION

1. Field of the Invention

The present invention relates generally to logging tool conveyance methods for highly deviated or horizontal wells. More specifically, the invention relates to downhole tractor tools that may be used to convey other logging tools in a well.

2. Background Art

The invention is a device that selectively grips or releases the well wall. It can also position the tractor tool at the center of the well bore.

Once a well is drilled, it is common to log certain sections of it with electrical instruments. These instruments are sometimes referred to as "wireline" instruments, as they communicate with the logging unit at the surface of the well through an electrical wire or cable with which they are deployed. In vertical wells, often the instruments are simply lowered down the well on the logging cable. In horizontal or highly deviated wells, however, gravity is frequently insufficient to move the instruments to the depths to be logged. In these situations, it is necessary to use alternative conveyance methods. One such method is based on the use of downhole tractor tools that run on power supplied through the logging cable and pull or push other logging tools along the well.

Downhole tractors use various means to generate the traction necessary to convey logging tools. Some designs employ powered wheels that are forced against the well wall by hydraulic or mechanical actuators. Others use hydraulically actuated linkages to anchor part of the tool against the well wall and then use linear actuators to move the rest of the tool with respect to the anchored part. A common feature of all the above systems is that they use "active" grips to generate the radial forces that push the wheels or linkages against the well wall. The term "active" means that the devices that generate the radial forces use power for their operation. The availability of power downhole is limited by the necessity to communicate through a long logging cable. Since part of the power is used for actuating the grip, tractors employing active grips tend to have less power available for moving the tool string along the well. Thus, an active grip is likely to decrease the overall efficiency of the tractor tool. Active grips have another disadvantage. This is the relative complexity of the device and, hence, it's lower reliability. A more efficient and reliable gripping device can be constructed by using a passive grip that does not require power for the generation of high radial forces. In one such design, the gripping action is achieved through sets of arcuate-shaped cams that pivot on a common axis located at the center of the tool. This gripping system allows the tractor tool to achieve superior efficiency. However, by virtue of the physics of their operation, the cams allow tractoring in only one (downhole) direction. Another limitation of this system is the relatively narrow range of well bore sizes in which these cams can operate. In addition, the cams cannot centralize the tool by themselves. This requires the usage of dedicated centralizers, which increase the tractor tool length.

Downhole tractor tools that use various methods of operation to convey logging tools along a well have been previously disclosed and are commercially available.

U.S. Pat. No. 6,179,055 discloses a conveyance apparatus for conveying at least one logging tool through an earth formation traversed by a horizontal or highly deviated borehole. The conveyance apparatus comprises a pair of arcuate-shaped cams pivotally mounted to a support member, a spring member for biasing the arcuate surface of each cam into contact with the borehole wall, and actuators operatively connected to each cam. A logging tool is attached to the conveyance apparatus. When either actuator is activated in a first direction, the cam connected to the activated actuator is linearly displaced forward and the arcuate surface of the cam slides along the borehole wall. When either actuator is activated in a second direction, the activated actuator pulls the connected cam backwards and the spring member thereby urges the arcuate surface of the cam to lock against the borehole wall. Once the cam is locked, further movement of the actuator propels both the conveyance apparatus and the logging tool forward along the highly deviated or horizontal borehole.

U.S. Pat. No. 6,089,323 discloses a tractor system which, in certain embodiments, includes a body connected to an item, first setting means on the body for selectively and releasably anchoring the system in a bore, first movement means having a top and a bottom, the first movement means on the body for moving the body and the item, the first movement means having a first power stroke, and the tractor system for moving the item through the bore at a speed of at least 10 feet per minute.

U.S. Pat. No. 6,082,461 discloses a tractor system for moving an item through a wellbore with a central mandrel interconnected with the item, first setting means about the central mandrel for selectively and releasably anchoring the system in a wellbore, the central mandrel having a top, and a bottom, and a first power thread therein, the first setting means having a first follower pin for engaging the first power thread to power the first setting means to set the first setting means against an inner wall of the bore. In one aspect, the tractor system is for moving the item through the bore at a speed of at least 10 feet per minute. In one aspect, the tractor system has second setting means on the central mandrel for selectively and releasably anchoring the system in the bore, the second setting means spaced apart from the first setting means, and the central mandrel having a second power thread therein and a second retract thread therein, the second retract thread in communication with the second power thread, and the second setting means having a second follower pin for engaging the second power thread to power the second setting means to set the second setting means against the inner wall of the bore.

U.S. Pat. No. 5,954,131 discloses a conveyance apparatus for conveying at least one logging tool through an earth formation traversed by a horizontal or highly deviated borehole. The conveyance apparatus comprises a pair of arcuate-shaped cams pivotally mounted to a support member, means for biasing the arcuate surface of each cam into contact with the borehole wall, and actuators operatively connected to each cam. A logging tool is attached to the conveyance apparatus. When either actuator is activated in a first direction, the cam connected to the activated actuator is linearly displaced forward and the arcuate surface of the cam slides along the borehole wall. When either actuator is activated in a second direction, the activated actuator pulls the connected cam backwards and the biasing means thereby urges the arcuate surface of the cam to lock against the borehole wall. Once the cam is locked, further movement of the actuator propels both the conveyance apparatus and the logging tool forward along the highly deviated or horizontal borehole.

U.S. Pat. No. 5,184,676 discloses a self-propelled powered apparatus for traveling along a tubular member that includes power driven wheels for propelling the apparatus, a biasing means for biasing the driven wheels into contact with the inner surface of the tubular member, and a retracting means for retracting the driven wheels from the driving position so that the apparatus can be withdrawn from the tubular member. The retracting means also include means to automatically retract the driven wheels from the driving position when the power to the apparatus is cut-off.

SUMMARY OF INVENTION

One embodiment of the invention comprises a linkage apparatus for selectively gripping and releasing the inside walls of a conduit, the apparatus comprising: a first arm; a bi-directional gripping cam rotatably attached to the arm; and an extension and locking device adapted to selectively radially extend the arm from a tool housing to an inside wall of a conduit and adapted to selectively lock the arm in an extended position.

Another embodiment of the invention comprises an apparatus for selectively gripping and releasing the inside wall of a conduit, the apparatus comprising: a plurality of linkages, each linkage comprising a first arm having a first end and a second end; a second arm having a first end and a second end, the second end of the first arm pivotably attached to the second end of the second arm, and a bi-directional gripping cam rotatably attached to at least one of the second end of the first arm and the second end of the second arm; a grip body, the first end of the first arm pivotably attached to the grip body; a hub, adapted to slide relative to the grip body, the first end of the second arm pivotably attached to the hub; and an extension and locking device adapted to selectively radially extend the linkages from the grip body and adapted to selectively lock the linkages in an extended position.

Another embodiment of the invention comprises a method for conveying a tool body through a conduit, comprising: moving a bi-directional gripping cam into contact with an inner wall of a conduit; laterally locking a position of the cam; and moving the tool body axially with respect to the cam in a first direction.

Advantages of the invention include one or more of the following:

- A device that acts as a tool centralizer;
- A device that selectively grips or releases the inside walls of a circular conduit such as a well or a pipe;
- A device with an extended operational range of well bore sizes;
- A device having double-sided cams that can grip in both the downhole and uphole directions;
- A device that provides superior efficiency and reliability; and
- A device having a passive grip system;

Other aspects and advantages of the invention will be apparent from the following description and the appended claims.

DETAILED DESCRIPTION

The present invention proposes an improved passive grip system. It may be used to centralize a logging or other well tool, allow bi-directional motion, and/or have a much wider operational range of well bore sizes than prior art systems. The invention is a combination of gripping cams and a centralizer with lockable geometry. It may be used to perform two major functions. The first is to act as a tool centralizer. The second is to selectively grip or release the inside walls of a conduit such as a well or a pipe. In one embodiment, the invention may be used as a part of a downhole tractor conveyance system. Its major elements may include a grip body, double-sided cams, cam springs, centralizer arms, wheels, hub, centralizer opening/closing device, and/or a locking device. The arms and the hub may be combined into linkages that can expand or contract radially as the hub slides with respect to the grip body in the axial direction. These linkages provide extended operational range, centralizing action, and when the hub is locked in place, support for the cams when they grip. The centralizer opening/closing device may selectively bias the linkages towards the well walls or close the arms back into the grip body. The cams are mounted at the tips of the linkages that come in contact with the well wall. The cams may be used to provide the gripping action. Since the cams are double-sided they can be used to grip in both the downhole and uphole directions. Cam springs may be provided to keep the cams in contact with the conduit wall. The wheels reduce the friction between the arms and the conduit wall when the device does not grip. The function of the locking device is to selectively lock or unlock the hub and thus the geometry of the centralizer. All these elements may be mounted onto the grip body.

The invention may be combined with a linear actuator, rails, a compensator, and an electronics block to form a tractor tool sonde. The grip body can slide back and forth on the rails of the sonde. One of the linear actuator's functions may be to reciprocate the grip body with respect to the rest of the sonde. The compensator provides pressure compensation of internal volumes and the fluid necessary for the operation of the grip. The electronics block may drive and control the electric motor of the linear actuator and the locking device. Two or more sondes may be used in a complete tractor tool to enable continuous motion of the tractor. In addition, the tractor tool may contains an electronics cartridge and a logging head that connects the tool to the logging cable. It may also contain additional auxiliary devices. The tractor tool may be attached to other logging tools that it can convey along the well.

Figure 1:
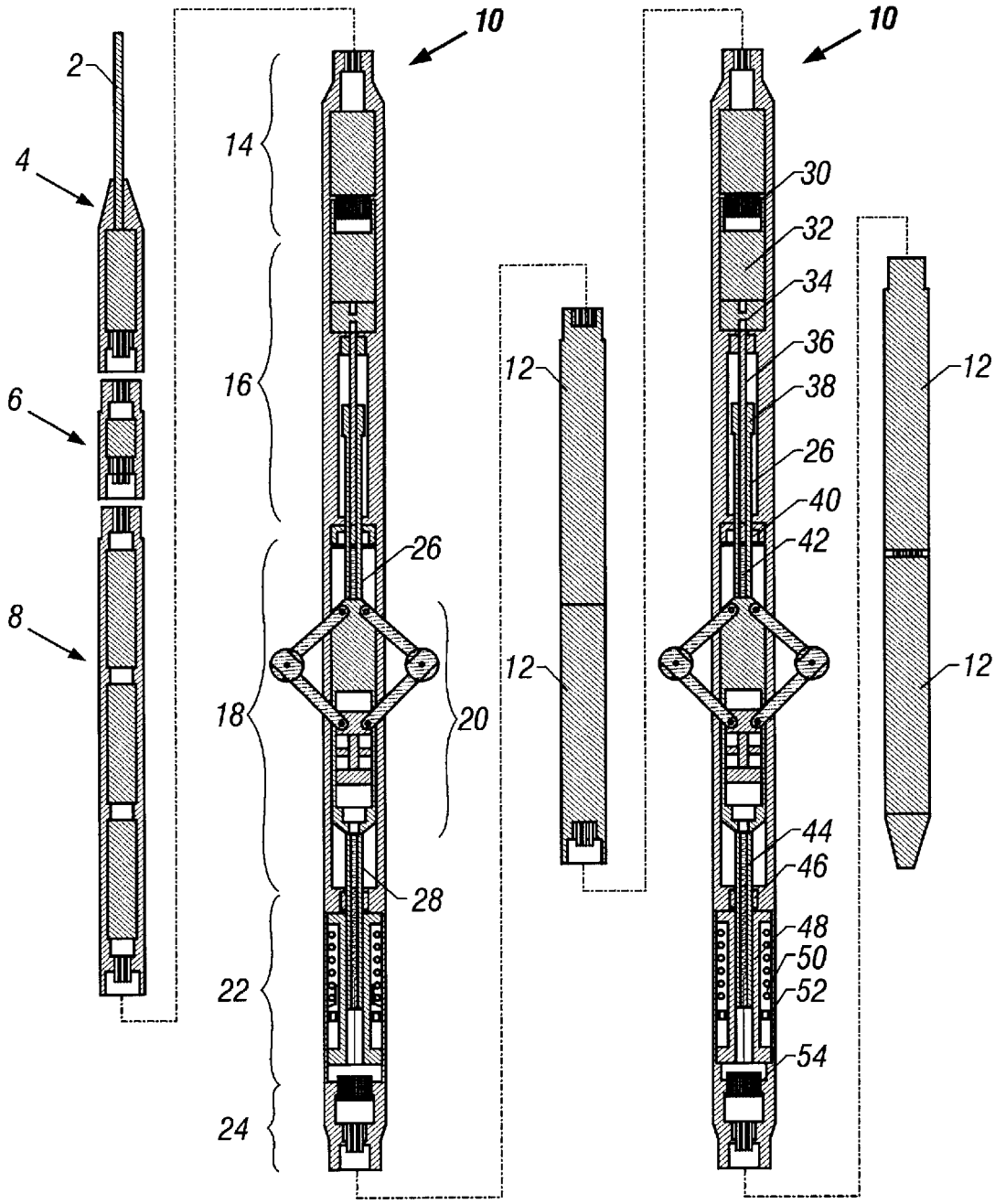
FIG. 1 is an cross-sectional view of the overall architecture of a downhole tractor conveyance system.

In one embodiment, the invention, further referred to as grip, may be a part of a downhole tractor conveyance system. One possible embodiment of the tractor system in a tool string is schematically shown in FIG. 1. The tool string shown in the figure comprises a logging head 4 that connects the tool string to the logging cable 2, auxiliary equipment 6, electronics cartridge 8, two tractor mechanical sondes 10, and multiple logging tools 12. The electronics cartridge 8 and the two mechanical sondes 10 comprise the downhole tractor conveyance system. The electronics cartridge 8 is responsible for communication with surface equipment and other tools in the tool string, supply of power to the logging tools, and control of the mechanical sondes 10. In another embodiment, the elements of the tractor system are not connected to each other and may have logging tools 12 between them as shown in FIG. 1.

In another embodiment, the grip, which is denoted with the reference number 20, may be a part of a mechanical sonde 10. Other elements of the mechanical sonde can include an electronics section 14, linear actuator section 16, rail section 18, compensator section 22, and lower head 24. The grip 20 slides back and forth inside the rail section 18 and is connected to the linear actuator section 16 and compensator section 22 through push rods 26 and 28. The grip 20 and the linear actuator 16, rail 18, and compensator 22 sections are oil-filled, while the electronics section 14 and the lower head 24 are typically air-filled. Bulkheads 30 and 48 separate the oil and air-filled sections of the tool and provide electrical communications between these sections. The role of the linear actuator 16 is to reciprocate the grip 20 along the rails 18. In this embodiment, the major elements of the linear actuator 16 are a motor 32, a gearbox 34, a ball screw 36, and a ball nut 38. The ball nut 38 is attached to push rod 26. The motor 32 is the prime source of mechanical power for the tool. The power and control circuits for the motor can be located in the electronics section 14. The ball screw 36 and the ball nut 38 convert the rotary motion at the output shaft of the gearbox 34 into linear motion. As the motor 32 rotates back and forth, the ball nut 38 reciprocates along the ball screw 36. This reciprocating motion is transmitted to the grip 20 through the push rod 26. The push rod 26 also contains a cocking piston 42, which acts as a source of high pressure when activating the grip 20. A compensator-side push rod 28 is mainly responsible for electrical and hydraulic communications between the grip 20 and the rest of the tool. This is schematically shown by the wire 44. Note that the grip 20 is exposed to well bore fluid. The push rods 26 and 28 have to repeatedly exit the oil-filled sections of the tool, get into the well bore fluids and then reenter the tool. Dynamic seals 40 and 46 prevent any entry of well fluids into the tool. The function of the compensator 22 is to provide pressure compensation, and hydraulic fluid necessary for the operation of the grip 20. The compensator 22 is piston-type, which major elements are a piston 50, spring 52 and dynamic seals 54. Except for the grip 20, all other elements of the mechanical sonde have been previously disclosed and are commercially available in embodiments similar to those shown in FIG. 1. These devices are discussed here because their presence is helpful in explaining the operation of the invention.

Figure 2:
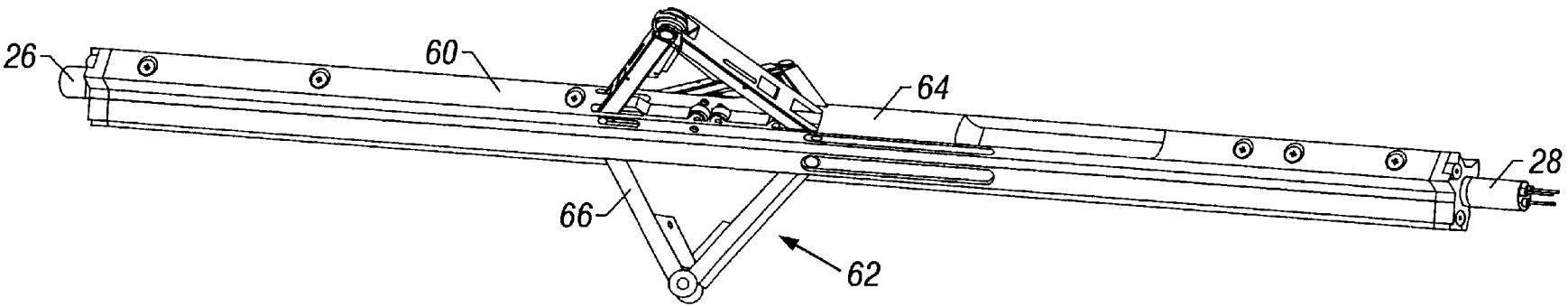
FIG. 2 is a three dimensional perspective view of the invention.
Figure 3:
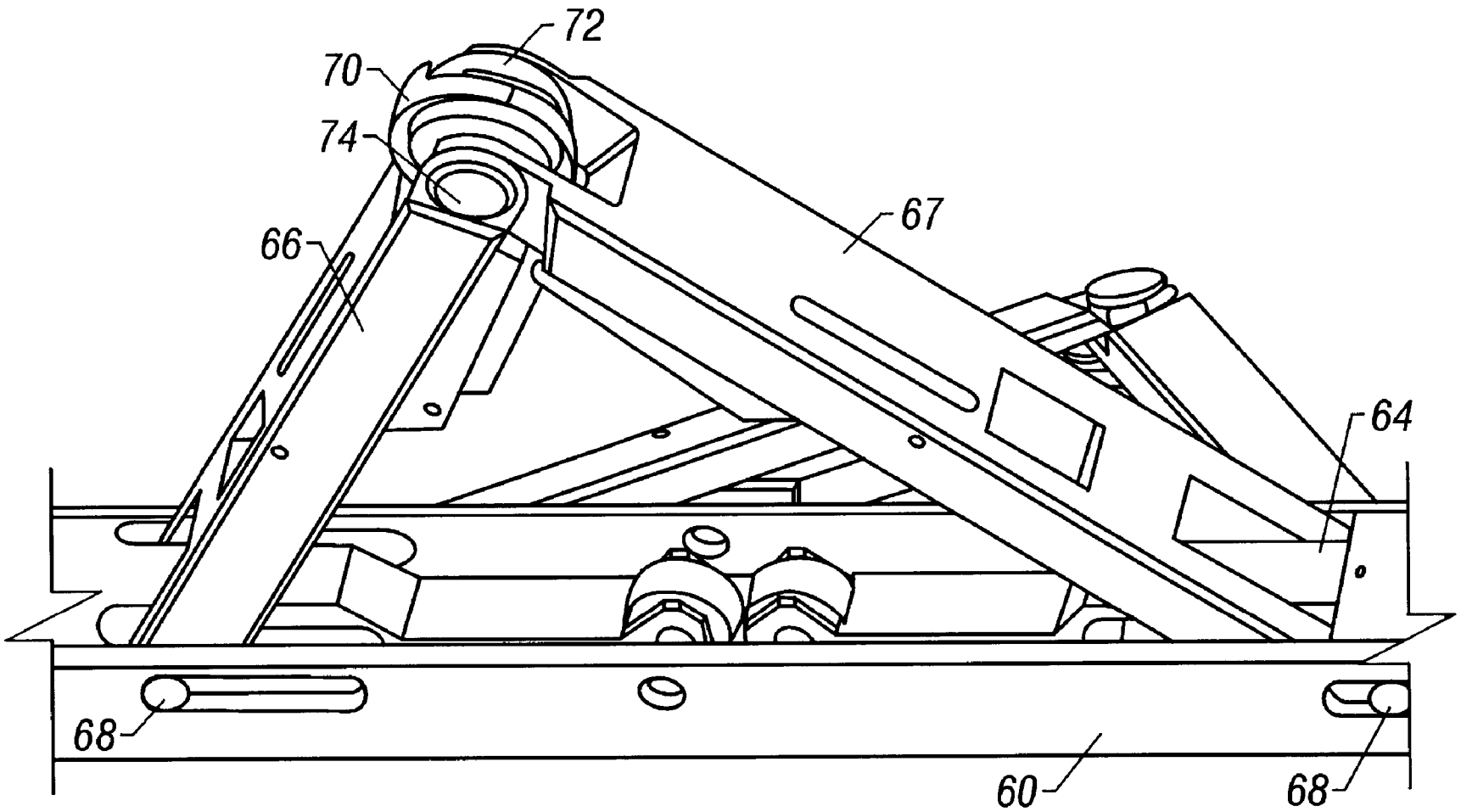
FIG. 3 is a magnified perspective view of one of the linkages of the invention.
Figure 4:
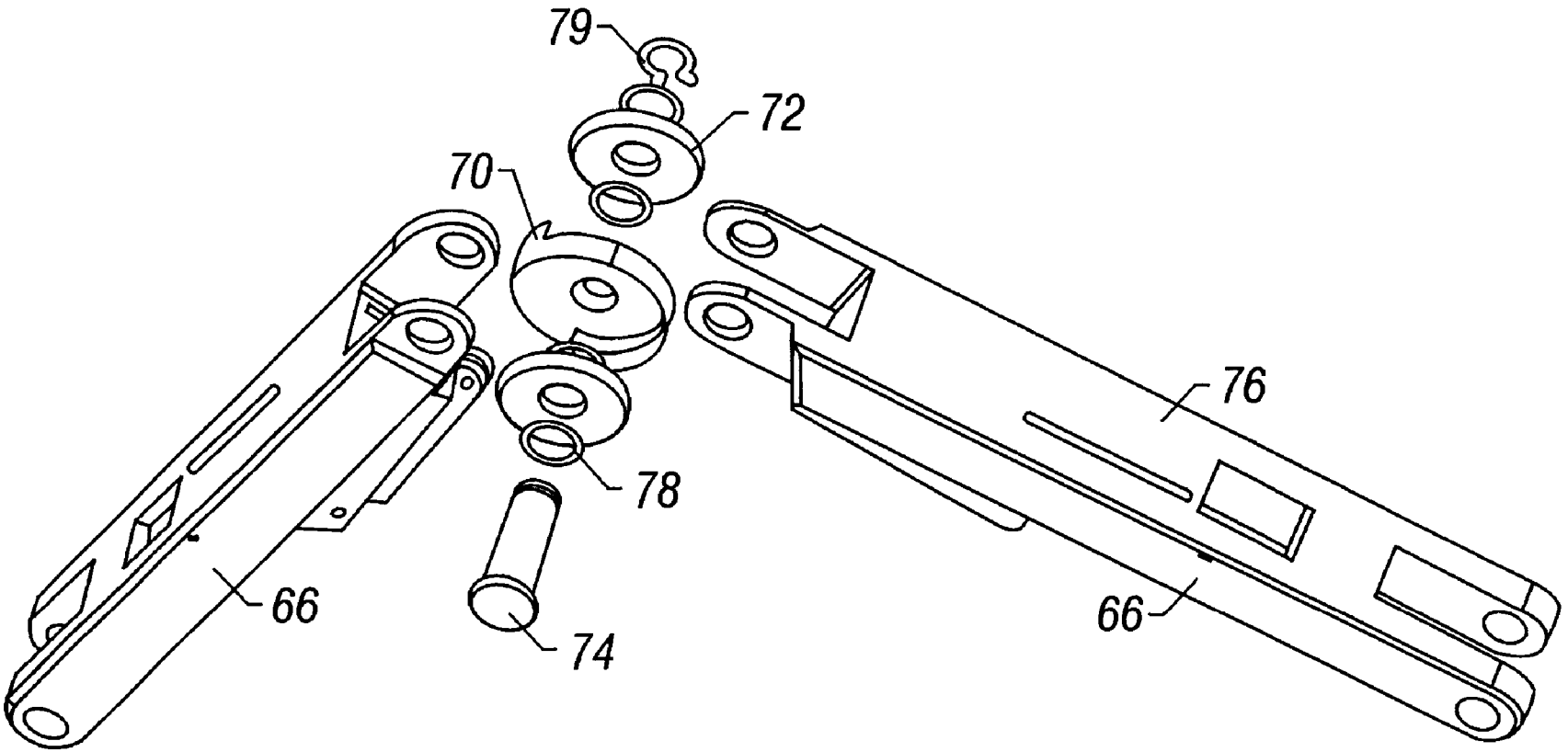
FIG. 4 is an exploded view of the elements of the linkage shown in FIG. 3.

In general, the invention comprises a grip body, double-sided cams, wheels, biasing springs, centralizer linkages, a hub, a centralizer opening/closing device and a locking device. A three dimensional view of the one possible embodiment of the invention is shown in FIG. 2 where the grip body is denoted by the reference number 60. Three sets of linkages 62 are attached to the grip body 60 and to a hub 64, which can slide with respect to the grip body 60. The grip body 60 is attached to the other parts of the tool (not shown) with push rods 26 and 28. A magnified view of one of the linkages 62 is shown in FIG. 3. The linkages 62 are comprised of a first arm 66, a second arm 67, and pins 68, which attach the first arm 66 and the second arm 67 to the grip body 60 and to the hub 64. The cams 70 and the wheels 72 are mounted on a common axle 74, which also joins the two arms 66. One possible arrangement of the elements that are located at the tip of the linkage 62 is shown in FIG. 4. The wheels 72 can rotate freely on the axle 74. The cams 70 also can rotate on the axle 74 but are oriented in an outward pointing direction by biasing springs (not shown in the figure) located in slots 76 cut in the arms 66. The wheels 72 and the cams 70 are separated by spacers 78, which prevent direct frictional interaction between the wheels 72 and the cams 70. The axle 74 is secured in place by a retaining ring 79.

Figure 5A:
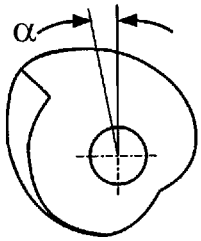
FIGS. 5A and 5C are side views of the double-sided cam geometry.
Figure 5B:
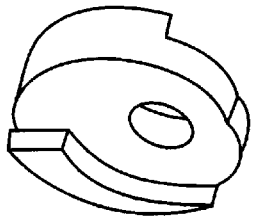
FIG. 5B is a perspective view of same.
Figure 5C:
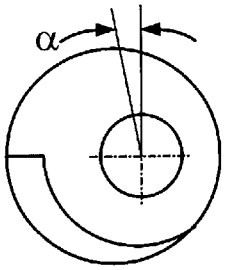

The shape of the cams 70 is an important feature of the invention. The shape is used to provide both gripping action and bi-directionality. A bi-directional gripping cam is shown in FIGS. 5A, 5B, and 5C. FIG. 5A is a front view, while FIG. 5B represents a three-dimensional view of the cam. The geometry of the cam is characterized by a constant contact angle, designated by the letter $\alpha$ in FIGS. 5A and 5C. The contact angle is defined as the angle between a line connecting the center of the cam pivot with the point of contact between the cam surface and a tangential plane, and the normal to that plane that passes through the cam axle. The advantage of this cam is that the contact angle does not change with the location of the contact point on the cam surface, which ensures consistent gripping force. Although the constant-angle is the geometry for the embodiment shown in FIG. 4, other geometries such as eccentric wheels (shown in FIG. 5C) or cams with variable contact angle may also be constructed to provide similar functionality.

Figures 6A, 6B, 6C:
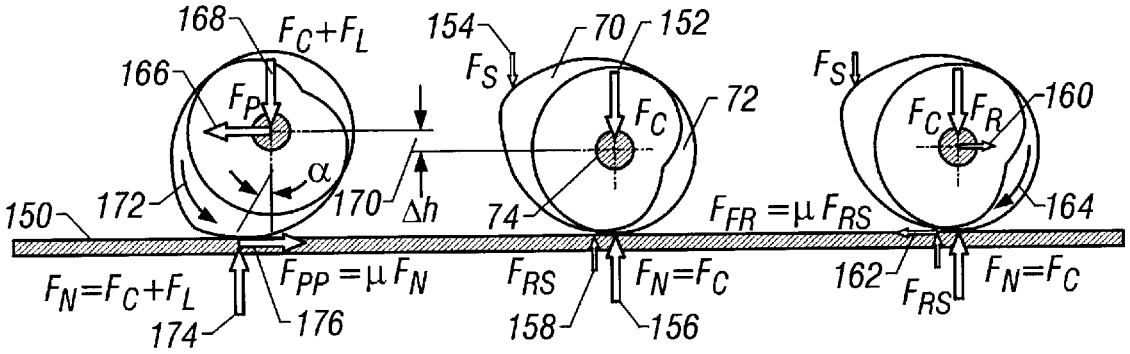
FIGS. 6A, 6B, and 6C are side views that demonstrate the gripping action of the cam.

The combination of the double-sided cam 70 with the wheels 72 is an important feature of the invention. Its different ways of interaction with the well wall determine the most important functions of the invention, including its ability to act as a centralizer, its ability to grip the well wall, and its ability to reverse direction. The interaction of the cam 70 and the wheels 72 with the well wall is explained in FIGS. 6A, 6B, and 6C. FIG. 6B represents a static contact between the cam/wheel system and the well wall 150. The contact is described as static because no axial forces $F_C$ 152 is applied to the centerline) are applied to the axle 74. A radial centralizing force $F_C$ 152 is applied to the axle 74 by a centralizing device, which is not shown in the figure and which is discussed in detail later. In addition, a much smaller force $F_S$ 154 is applied to the cam surface, which is the resultant of the action of two cam springs (shown at 157 in FIGS. 11A–E). The function of the cam springs 157 is to keep cam 70 in constant contact with the well wall 150. The centralizing force $F_C$ gives rise to a reaction force $F_N$ 156 in the point of contact between the wheel 72 and the wall 150. The cam 70 also contacts the wall 150 but in a different contact point. As explained in FIG. 5A, this contact point is always at an angle $\alpha$ from the normal direction. The force at the point where the cam 70 contacts the wall is denoted by $F_{RS}$ 158. Note that this force is much smaller than $F_C$ 152 because force $F_S$ exerted by the cam spring 157 is much weaker than the force $F_C$ exerted by the centralizing device. Thus, in this situation, the wheel 72 carries the majority of the radial load.

Now consider the application on axle 74 of an axial force $F_R$ 160 pointing to the right. This situation is shown in FIG. 6C. The axial force creates a tendency of the whole system to move to the right and gives rise to frictional forces at both contact points on the wheel 72 and the cam 70. Under the influence of the axial force $F_R$ 160, the wheel 72 starts to roll on the well wall 150, as indicated by the arrow 164. Since rolling contacts are characterized by very small coefficients of friction, the frictional drag due to the interaction between the wheel and the well wall is negligible. For this reason it is not shown in FIG. 7C. The other contact point is between the cam 70 and the well wall 150. It is characterized by sliding friction and, hence, a much larger coefficient of friction. This contact, however, does not generate much frictional drag either. The reason is that the frictional force $F_{FR}$ 162 tends to rotate the cam in the clockwise direction and thus out of contact with the well wall 150. Thus, the spring force $F_S$ 154 and the frictional force $F_{FR}$ 162 act against each other, which results in minimal frictional drag. Another reason for the small magnitude of $F_{FR}$ is that the radial force $F_S$ that generates it is quite small. In summary, the motion of the cam/wheels system to the right generates very little frictional interaction between the tip of the linkage 62 (FIG. 4) and the well wall 150. This results in practically free rolling of the grip with respect to the well wall 150 when pushed to the right. Also note that during this rolling motion, the axle 74 stays at a substantially constant distance from the well wall.

Application of an axial force $F_P$ 166 in the opposite direction (pointing to the left) is shown in FIG. 6A. As the direction of motion changes, so are the friction forces at all contact points. The friction force, which in FIG. 6C tended to rotate the cam 70 in the clockwise direction and, thus, away from the wall 150, now forces the cam to rotate in the counterclockwise direction, as indicated by the arrow 172. The geometry of the cam 70 is such (see FIG. 5) that when it rotates on its axle, its contact radius (defined as the distance between the contact point and the axis of the cam axle) either increases or decreases. In this case it increases. Thus, as the cam 70 rotates, it becomes wedged against the well wall 150 by the frictional force $F_{FP}$ 176 at the contact point. Also, its contact radius becomes larger than the radius of the wheels 72 and the wheels 72 come out of contact with the well wall. Note that this action also requires that the axle 74 move away from the well wall, as indicated by the change in distance denoted by $\Delta h$ 170. This change in distance usually involves an increase in the magnitude of the radial force. In FIG. 6A, this is shown by the addition of the force $F_L$ to the existing centralizing force $F_C$ 168. After the wheels lift off from the wall surface, the whole radial load is carried by the cam 70. This, in turn, leads to higher normal contact forces and, consequently, higher friction. Higher friction forces wedge the cam harder against the wall, which leads to even higher frictional forces, and so on. This is a self-actuating process, which can result in an extremely high radial contact force. This is especially true if the axle 74 is prevented from moving away from the well wall by some mechanical locking device (not shown). In the latter case, the rolling of the cam 70 with respect to the well wall stops and the only possibility for relative motion between the cam and the well wall is through sliding friction. A moderate coefficient of friction at the contact point between the cam 70 and the well wall 150 combined with the very large force $F_N$ 174 can generate high enough frictional force $F_{FP}$ 176 to prevent any relative sliding between the cam 70 and the well wall 150. In this situation, the grip (20 in FIG. 1) grips the well wall and becomes anchored in place.

Figures 7A, 7B, 7C, 7D:
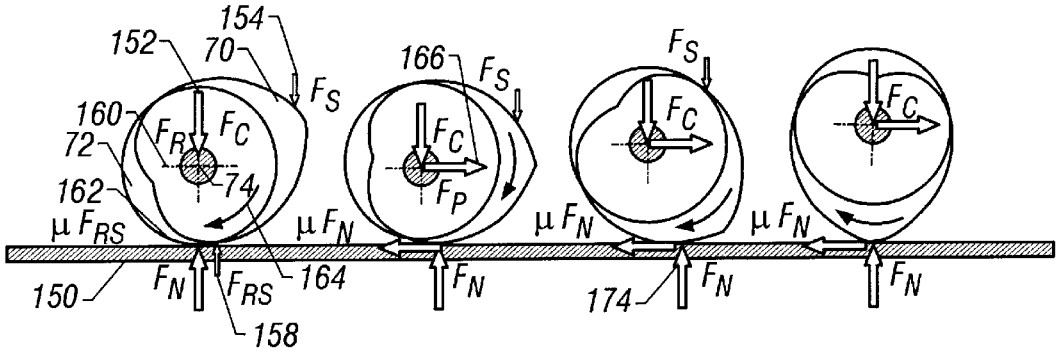
FIGS. 7A through 7H are side views that illustrate the process of cam reversal.
Figures 7E, 7F, 7G, 7H:
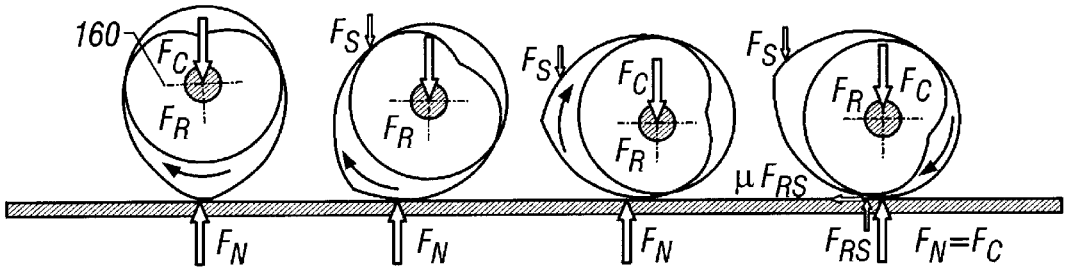

FIGS. 7A through 7H show the reversal of the cam 70, which then allows change in the direction of tractoring. The cam reversal process is similar to the process of gripping the casing that was explained with regards to FIG. 6A. However, in this case, the vertical displacement of axle 74 is not constrained. In the position of the cam/wheel system shown in FIG. 7A, the system can move freely to the left and grip if forced to the right. In its initial stage, the cam reversal process follows the events explained in FIG. 6A. An axial force $F_R$ 160 is applied to the cam axle 74. A reaction friction force $\mu F_{RS}$ 162 is then generated by the tendency of the cam 70 to slide with respect to the well wall 150. The forces $F_R$ and $\mu F_{RS}$ rotate the cam 70 in the direction indicated by the arrow 164. The rotation of the cam 70 in the clockwise direction tends to increase the contact radius of the cam, which pushes axle 74 upward. Since the wheels' radius is smaller than the contact radius of the cam 70, the wheels 72 come out of contact with the well wall. These events are shown in FIG. 7B, wherein the axial force on the axle 74 is denoted by $F_P$ 166. This indicates the increase in axial force necessary to push the axle 74 upwards and to roll the cam towards increasing its contact radius. The next phase in the rotation of the cam is shown in FIG. 7C. This figure is the mirror image of FIG. 6A. As explained with respect to FIG. 6A, the rotation of the cam 70 will stop and the cam will grip the casing if axle 74 is locked in place radially. In contrast, in FIG. 7C, the axle 74 remains unlocked and the rotation of cam 70 continues. This process leads to the situation shown in FIG. 7D. In this position, cam 70 makes contact at its largest contact radius and is at the turning point of flipping over. FIG. 7E shows the moment just after flipping the cam beyond its largest radius. Note that the axial force has dropped substantially in value and is again indicated by $F_R$ 160. From this point on forces $F_C$, $F_N$, and $F_R$ all act to continue the rotation of the cam, which for this reason proceeds very quickly. Consecutive positions of the cam are shown in FIGS. 7F and 7G. Finally the can comes to the position shown in FIG. 7H, which is exactly the same as that shown in FIG. 6C. From this point on, the cam/wheel assembly moves with very little resistance with respect to the well wall 150, as explained with respect to FIG. 6C. This completes the reversal of the cam 70. Note that the cam/wheel system now moves freely to the right and grips when an attempt is made to move it to the left as long as the radial position of the axle 74 is locked or fixed. This is exactly the opposite of the position shown in FIG. 7A. Thus, the reversal of the cam 70 has the effect of changing the direction of tractoring.

In addition to the elements explained above, the grip (20 in FIG. 1) also includes a centralizer opening/closing device and a locking device. There are a number of possible embodiments for these devices, including but not limited to a fully hydraulic system, an electromechanical system, and combinations of these systems. The embodiment of a fully hydraulic system for the centralizer opening/closing device and the locking device is presented in detail in FIGS. 8–11. The embodiment of an electromechanical system is schematically presented in FIG. 12.

Figures 8A, 8B, 8C:
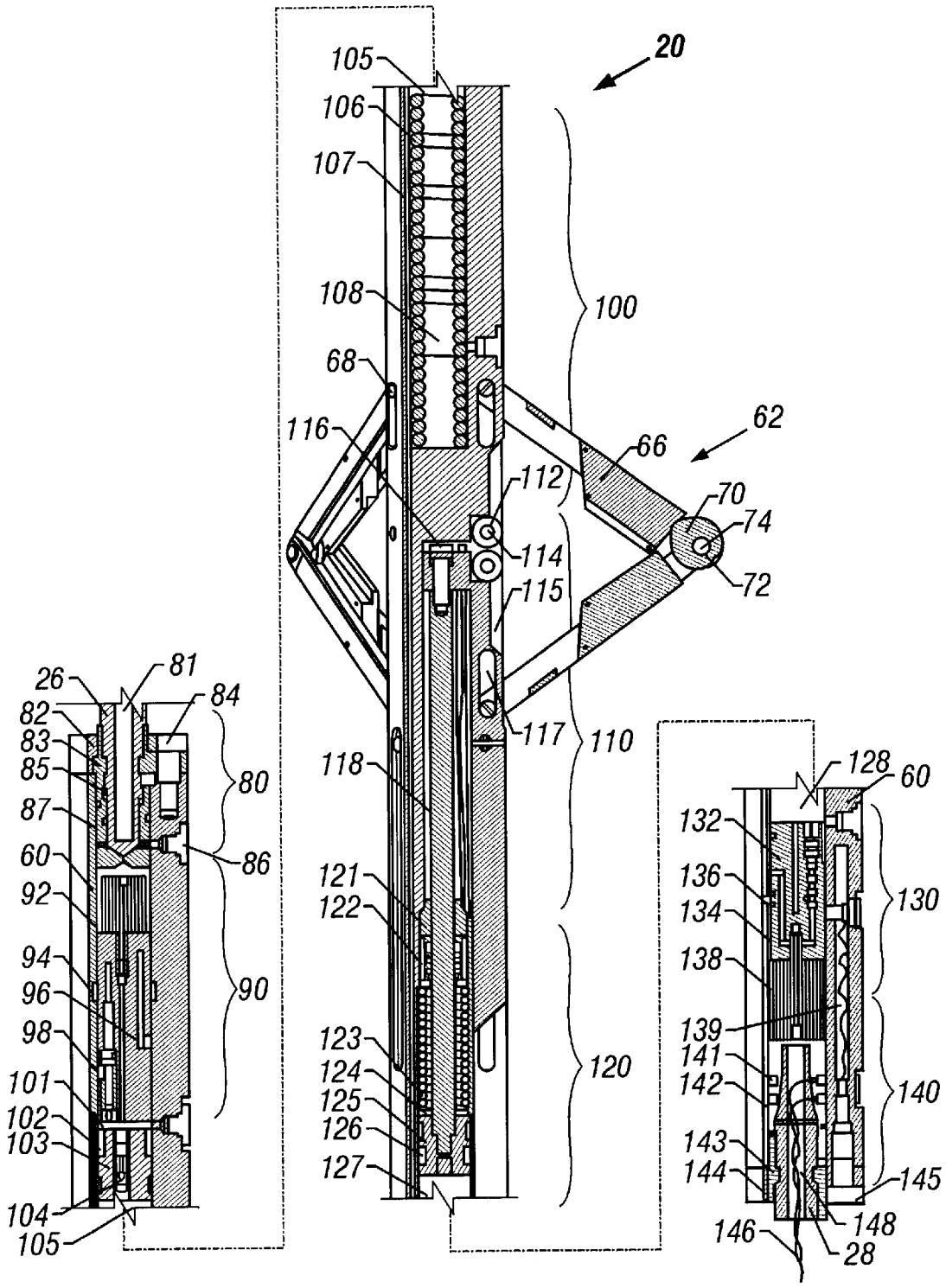
FIGS. 8A, 8B, and 8C are longitudinal cross-sectional views of a hydraulic embodiment of the invention.

The top portion of the hydraulic embodiment of the grip is shown in FIG. 8A. FIG. 8B is a continuation of FIG. 8A, and FIG. 8C is a continuation of FIG. 8B. The grip body 60 is connected to other parts of the tractor tool (not shown in FIG. 8) through push rods 26 on the top and 28 on the bottom. As explained earlier, the push rods are used to reciprocate the grip in the rail section (18 in FIG. 1) and to provide electrical and hydraulic communications.

The embodiment of the grip shown in FIG. 8 can be subdivided into several major sections depending on their functionality. These major sections from top to bottom are drive rod attachment 80, opening/closing hydraulic block 90, high pressure accumulator 100, linkages section 110, grip actuator 120, locking hydraulic block 130, and compensator rod attachment 140. These elements are discussed in more detail below.

The forces involved in reciprocating the grip along the rails are equal to the pull that the tractor tool creates and can be substantial. Therefore, special attention should be paid to the attachment of the push rods 26 and 28 to the grip body 60. The drive section attachment consists of a split clamp 83 and an end cap 82, which is attached to the grip body 60 with bolts 84. Passage 81 in the push rod 26 is used for fluid communication between the grip and a cocking piston (not shown in FIG. 8), which will be explained later. Static seals 85 are used to seal off external well fluids from the internal volumes of the tool. The invention also includes several identical fill ports 86, which are used for initial filling of the tool with oil, for pressure measurements, and inspection.

The opening/closing hydraulic block 90 includes a hydraulic block body 96, a solenoid valve 92, check valves 98 and a contact assembly 94. The latter is used to supply electrical power to the solenoid valve 92, which can be selectively opened or closed by the control circuits located in the electronics block (14 in FIG. 1). The function of the check valves 98 is to direct the fluid flow in the proper chamber of the grip. A more detailed description of the role of the various hydraulic components is provided later with respect to FIG. 11.

The third major section presented in FIG. 8 is the high-pressure accumulator 100. It is located inside chamber 108 of grip body 60. The major elements of the high-pressure accumulator are a floating piston 103 and a spring 106. High-pressure dynamic seals 102 mounted on the piston 103 separate the high- pressure region 101 on the top of the piston from the low-pressure region 105 at the bottom. In addition, a pressure relief valve 104 is mounted inside the piston 103. The role of the valve 104 is to set the maximum pressure of the high-pressure accumulator 100.

The next section of the grip is the linkages section 110. In the embodiment shown, this section houses three identical linkages 62 (described earlier in FIGS. 3–6) as well as the centralizer hub 64. In other embodiments the linkages section 110 may have 2, 4, 5, or 6 linkages. The hub 64 is connected to the piston rod 118 with a bolt 116, ensuring that the motion of the piston rod 118 is transmitted to the hub 64. Other elements of this section are the auxiliary wheels 112 that pivot on hubs 114. These wheels 112 are used to assist the opening of the arms in small-diameter well bore sizes. Features of the grip body 60 in this section include special cuts 115 and slots 117 that provide space for the linkages when the grip is fully closed. The closing of the linkages 62 into the grip body 60 can be better understood by examining FIG. 9, which will be discussed later. Also shown in FIG. 8 are internal passages 107, which are used for hydraulic communication, as well as for passage of electrical wires. The hydraulic connections are discussed in more detail in FIG. 11.

The function of the grip actuator 120 is to force the hub 64 to slide with respect to the grip body 60, thus, opening or closing linkages 62 into the grip body 60. Another function of the actuator 120 is to react the large axial forces that may be created by the cams 70 and then transmitted through the linkages 62 and the hub 64 to the actuator rod 118. The actuator 120 is similar to a single-acting hydraulic cylinder. It consists of a piston 125 that is attached to the actuator rod 118. The piston 125 slides inside bore 128 in the grip body 60. The piston 125 separates the cylinder chamber 128 into a low-pressure region 124 on top of the piston 125 and a high-pressure region 127 at the bottom. High-pressure dynamic seals 126 prevent fluid communication between the low 124 and high 127 pressure regions. In addition, dynamic seals 122 mounted in a seal cartridge 121 seal around the surface of the actuator rod 118 and prevent external fluid from entering the cylinder chamber 128. When the pressure in region 127 exceeds the pressure in region 124, the piston 125 is pushed upward. This motion is transmitted through the actuator rod 118 to the hub 64, which, in turn, drives linkages 62 out of the grip body 60. When the pressure on both sides of the piston 125 is the same, spring 123 pushes piston 125 downward, resulting in closing linkages 62 into the grip body 60.

The pressure in the actuator 120 is controlled by the locking hydraulic block 130. Its function is to open or close the ports that connect chamber 128 to the rest of the grip. When these ports are closed, the fluid volume inside the actuator 120 is trapped. Since this fluid is practically incompressible (in one embodiment, oil), the effect of trapping the fluid is to lock the hub 64 in place and, thus, the geometry of linkages 62. Similar to the hydraulic block 90, discussed previously, the locking hydraulic block 130 consists of a body 132, solenoid valve 134 and a contact assembly 136 that provides electric power to the solenoid valve. The contact assembly is connected to other electrical contacts 141 with the wire 138, which runs along a hole 139 in the grip body 60.

The last major section of the grip is the compensator-side push rod attachment 140, which joins the push rod 28 to the grip body 60. This attachment is very similar to the drive rod attachment 80. It consists of a clamp 143 and an end cap 144 that is bolted to the grip body 60 with screws 145. The attachment 140 also has static seals 142 that isolate the internal volumes of the grip from external fluids. The compensator-side push rod attachment 140 also provides oil communication with the tractor tool low-pressure compensator (24 in FIG. 1) through an internal channel 148. The major difference between rod attachments 80 and 140 is the presence of electrical contacts 142 in attachment 140. These contacts are used to supply power to solenoid valves 92 and 134. These contacts are also connected with the electronics block (14 in FIG. 1) by wires 146 that run in the channel 148.

Figure 9A:
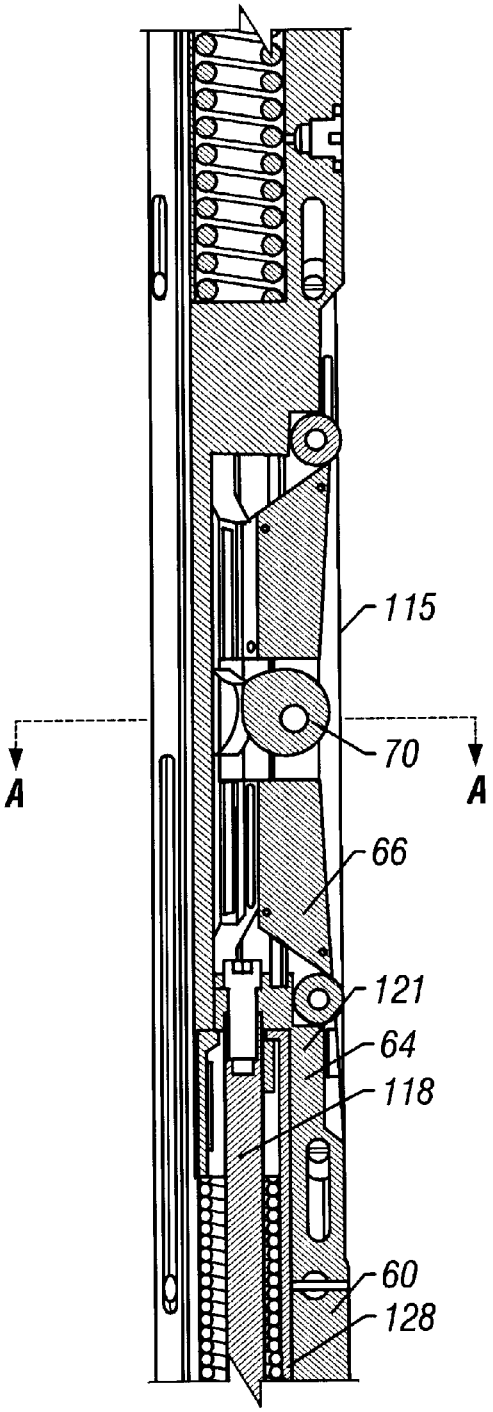
FIGS. 9A and 9B are longitudinal cross-sectional views of a hydraulic a embodiment of the invention in different states of operation.
Figure 9B:
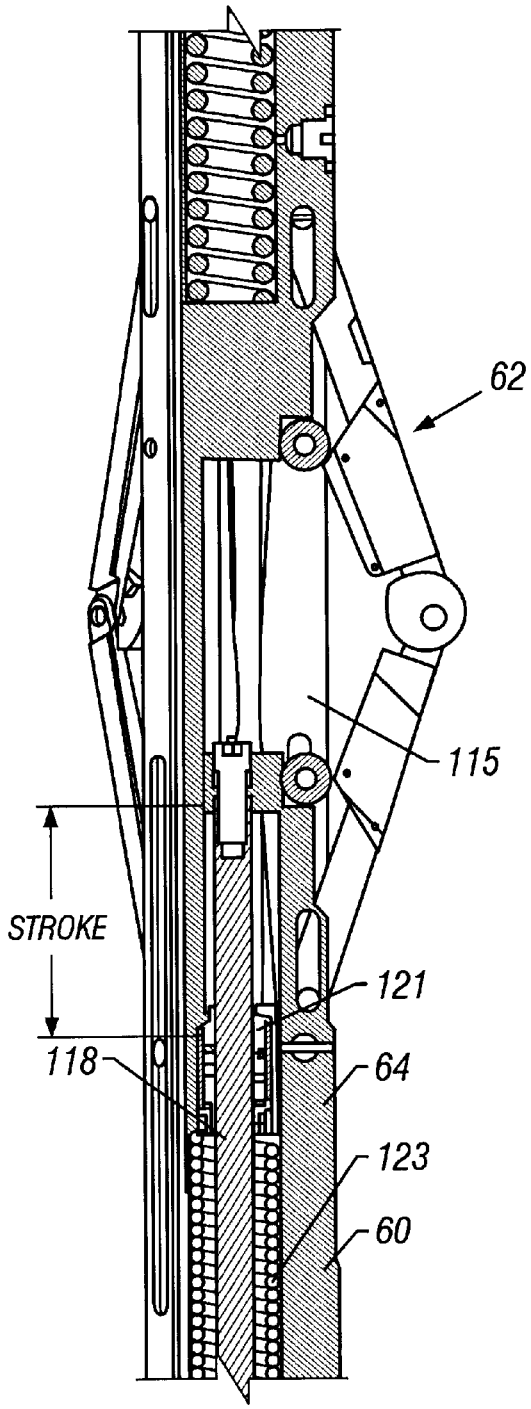

In FIG. 8, linkages 62 are shown in a filly open position. This corresponds to the topmost position of the hub 64 and the piston 125. As mentioned earlier, one of the advantages of a grip according to various embodiments of the invention is its capability to cover a large range of well bore sizes. To achieve this, linkages 62 can fold completely into the grip body 60. Linkages 62 are also capable of assuming any intermediate position between their fully open and fully closed states. This is demonstrated in FIGS. 9A and 9B. FIG. 9A shows the same elements of the grip that were described in FIG. 7B with linkages 62 in the fully closed position. FIG. 9B, on the other hand, shows linkages 62 in an intermediate position. Note that in FIG. 9A, the arms 66 are completely retracted into the grip body cuts 115. Even the cams 70 are retracted below the outline of the grip body 60. Also note that the hub 64 is in contact with the seal cartridge 121 and the actuator rod 118 is completely inside the cylinder chamber 128. In FIG. 9B, the actuator rod is extended upward by the distance denoted by "STROKE" in FIG. 9B. The hub 64 has moved the same distance. This has forced linkages 62 to move out of cuts 115 in the grip body 60 and to expand outwardly in the radial direction. Further upward movement of the actuator rod 118 will cause the linkages 62 to extend even further out. This process of outward expansion can continue until the rod 118 exhausts its stroke or the spring 123 is compressed solid.

Figure 10A:
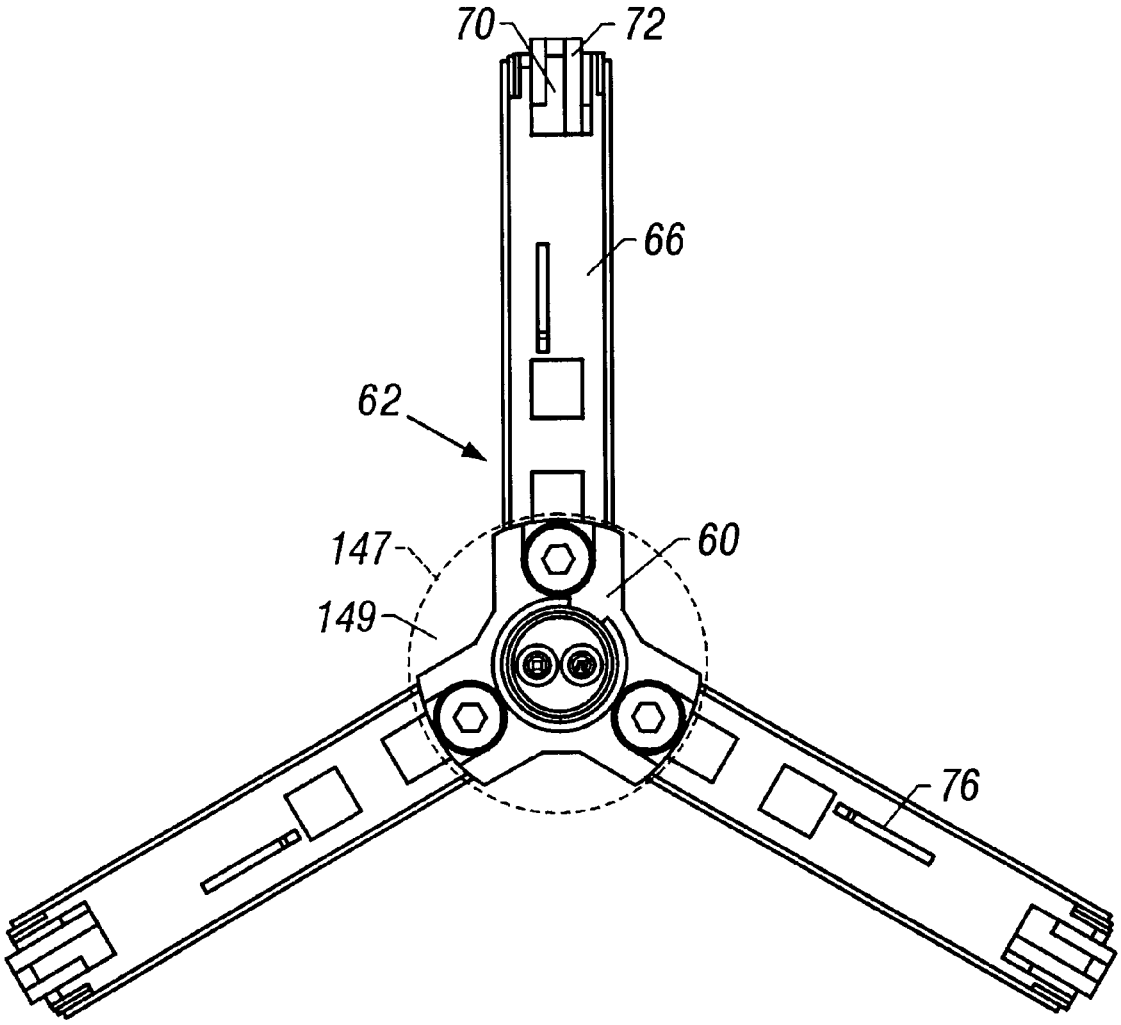
FIG. 10A is a top view of the invention in its fully open state.
Figure 10B:
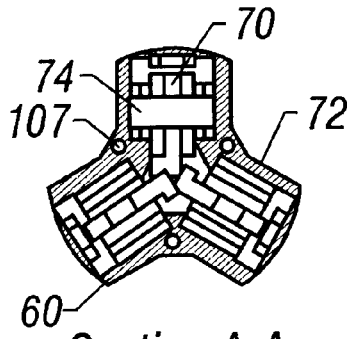
FIG. 10B is a sectional view of a hydraulic embodiment of the invention in a fully closed state taken along the section line A—A of FIG. 9A.

In the front cross-sectional view of the grip shown FIG. 9A, it is difficult to appreciate the amount of radial expansion that can be achieved by the grip. This is more clearly shown in FIG. 10. FIG. 10A represents a top view of the grip in its fully open state. FIG. 10B, on the other hand, shows a cross section through the middle of the grip (denoted by 10B—10B in FIG. 9A) when it is fully closed. FIG. 10A shows that the grip's radial dimensions can reach several times the envelope of the grip body 60. FIG. 10A also presents a different view for the elements of the linkages 62 that were explained in FIGS. 3 and 4. Also note the three-lobe shape of the grip body 60. This shape is required because the grip has to slide inside the rail section (18 in FIG. 1). The space 149 between the lobes and the circle 147 defined by the outlines of the grip body is occupied by the rails, on which the grip slides. FIG. 10B also shows how the cams 70, wheels 72, axles 74, and the other elements located at the tips of the linkages 62 fit inside the grip body 60. Note that when the linkages are fully closed the cams 70 meet at the centerline of the grip body 60. The cross section in FIG. 10B also shows three of the oil and wire communication passages 107 that are machined into the grip body 60.

Figure 11A:
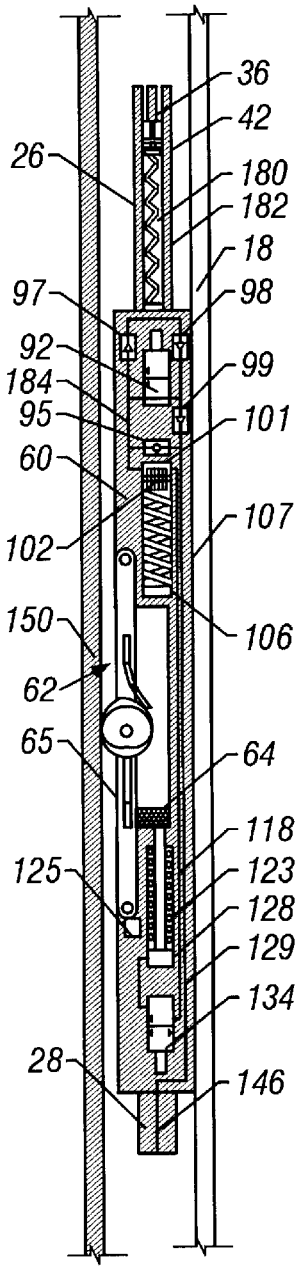
FIG. 11A through 11E are longitudinal cross-sectional views of a hydraulic embodiment of the invention that schematically show the major operational processes.
Figure 11B:
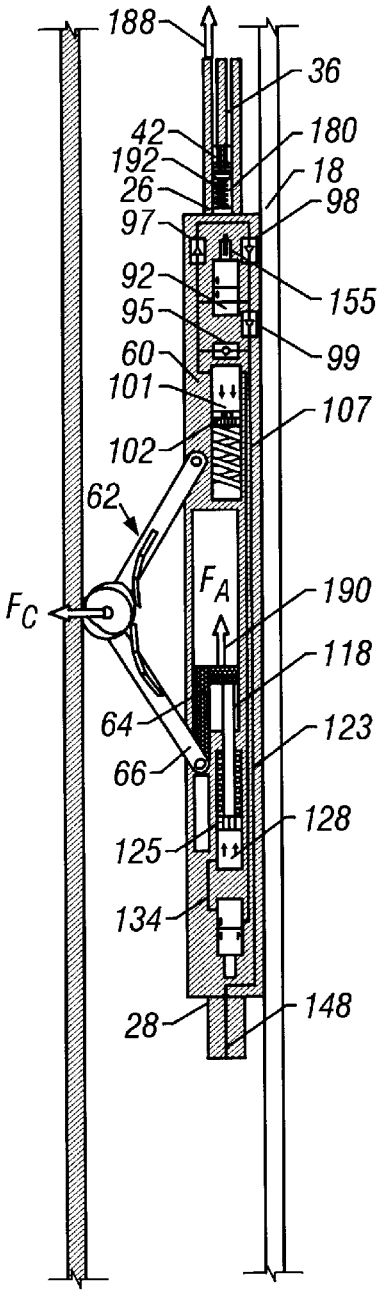
Figure 11C:
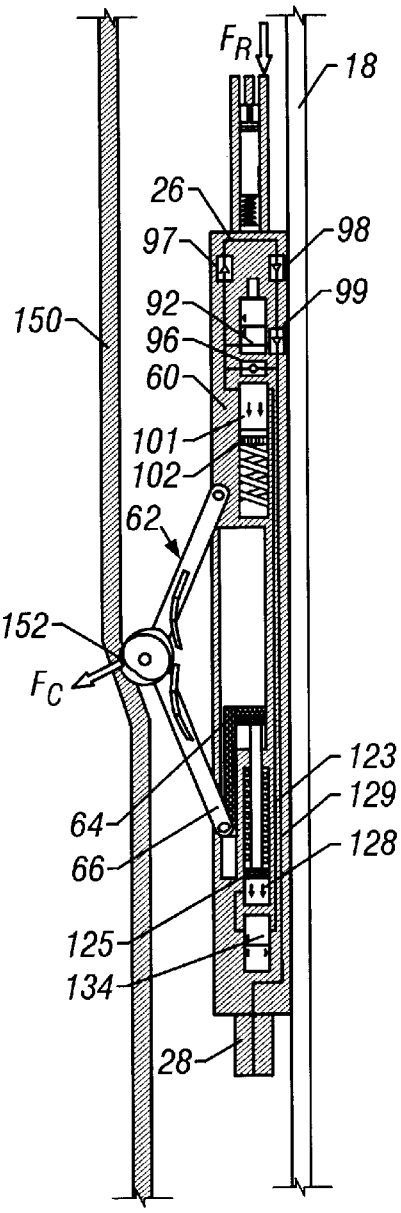

The principle of operation of the embodiment of the invention that was shown in FIGS. 8–10 is explained in FIGS. 11A through 11C. This figure shows a simplified representation of the embodiment of the invention. The simplification is done for the sake of clarity when explaining the principle of operation. In FIG. 11, only one of the linkages 62 is shown because all linkages operate in a substantially identical manner. Similarly, only one of the rails of rail section 18 is shown. FIGS. 11A through 11C also depict the hydraulic communications between different sections of the grip. The numerical notations used in FIGS. 11A through 11C are the same as those in the figures explained earlier.

FIG. 11A shows the invention in its initial non-powered state. In this state, linkages 62 are fully closed into the grip body 60. This state corresponds to the cross sectional view of the grip shown in FIG. 10B. If the tractor tool is located in a horizontal section of a well, and if the grip is closed, the tractor tool body lies at the bottom of the well bore. Note that in FIG. 11A both solenoid valves 92 and 134 are not powered and open. Solenoid valve 134 allows hydraulic communication between chambers 101 of the high-pressure accumulator (100 in FIG. 8B) and 128 of the grip actuator (120 in FIG. 8B). The other solenoid valve 92 and check valves 95, 97, 98, and 99 allow communication between chamber 101, the cocking piston chamber 180 and through push rod 28 the compensating section of the tool (22 in FIG. 1). Thus, all internal volumes of the grip are at the same pressure, which is equal to the pressure generated by the tractor tool compensator (22 in FIG. 1). In this situation, piston 102 is kept in its topmost position by spring 106 and piston 125 is pushed down by spring 123. The hub 64 is also all the way down and the actuator rod 118 is fully retracted into the grip body 60. Through piston 125, actuator rod 118, and hub 64, spring 123 exerts closing force on linkages 62 and keeps them retracted into the grip body 60. Thus, the linkages 62 do not extend beyond the outlines of the grip body 60, which corresponds to the situation shown in FIG. 9A.

FIG. 11B demonstrates one function of the grip, which is to centralize the tractor tool in the well bore. This centralization is achieved by pushing linkages 62 out of the grip body in the radial direction until they lift the tool off the well wall and position it at the center of the bore. This process begins by powering solenoid valve 92, which is indicated by arrow 186. Next, the grip (20 in FIG. 1) is pulled up by the linear actuator section (16 in FIG. 1). Initially, cocking piston 42 travels with the grip and is kept in its topmost position by cocking spring 182. As the grip moves upwards, cocking piston 42 comes in contact with the end of the ball screw 36, which prevents further upward motion of piston 42. Since the motion of the grip 60 continues, the volume of chamber 180 in push rod 26 decreases. The pressure of the fluid trapped in this chamber increases, which is indicated by arrow 192. The fluid used in the grip is substantially incompressible (in one embodiment, oil), hence, it forces its way out of the chamber. Since solenoid 92 is closed, the only possible way for the fluid to escape is through check valve 97 into chamber 101. From chamber 101, the high pressure fluid goes into passage 123 and through solenoid valve 134, chamber 128. The high pressure in chamber 101 pushes piston 102 down, compressing spring 106. At the same time, the pressure in camber 128 pushes piston 125 up. The pressure exerted on piston 125 creates the axial force 190 designated by FA in the figure. The latter is transmitted through linkages 62 creating the radial centralizing force 152, designated by $F_C$ in FIGS. 6A, 6B, 6C, 7A through 7H, 11A, 11B, and 11C. As the pressure in chamber 180 increases, the centralizing force $F_C$ becomes high enough to overcome the weight of the tool and lifts the tool off the well wall. Due to the radial symmetry of linkages 62 (see FIG. 2) and due to the fact that they all are attached to the same hub 64, the tool body moves towards the center of the well bore. When the tool is positioned at the center of the well bore, the pumping of fluid through rod 26 is stops. In this state, the grip 20 is ready to perform its function of a tool centralizer. Note, that although the grip 20 exerts radial forces that centralize the tool, the geometry of the linkages is not locked. This is demonstrated in FIG. 11C. When the tool is pulled through a restriction by force $F_R$ 160, linkages 62 must contract radially. This requires the hub 64, actuator rod 118, and piston 125 to move down. This reduces the volume of chamber 128 and fluid must flow out of it. This is possible because solenoid valve 134 is still open. Through passage 129 the extra fluid goes to chamber 101 pushing piston 102 down. Thus, the flexibility of the centralizer and the capability of the invention to adjust to changes in well bore size are ensured by the high-pressure accumulator (100 in FIG. 8). The processes just described are reversed if the grip moves from a smaller to a larger well bore. In this case fluid flows from the high-pressure accumulator (camber 101) to the grip actuator chamber 128. Under all these circumstances, the grip continues to exert radial centralizing forces on the well wall.

Figure 11D:
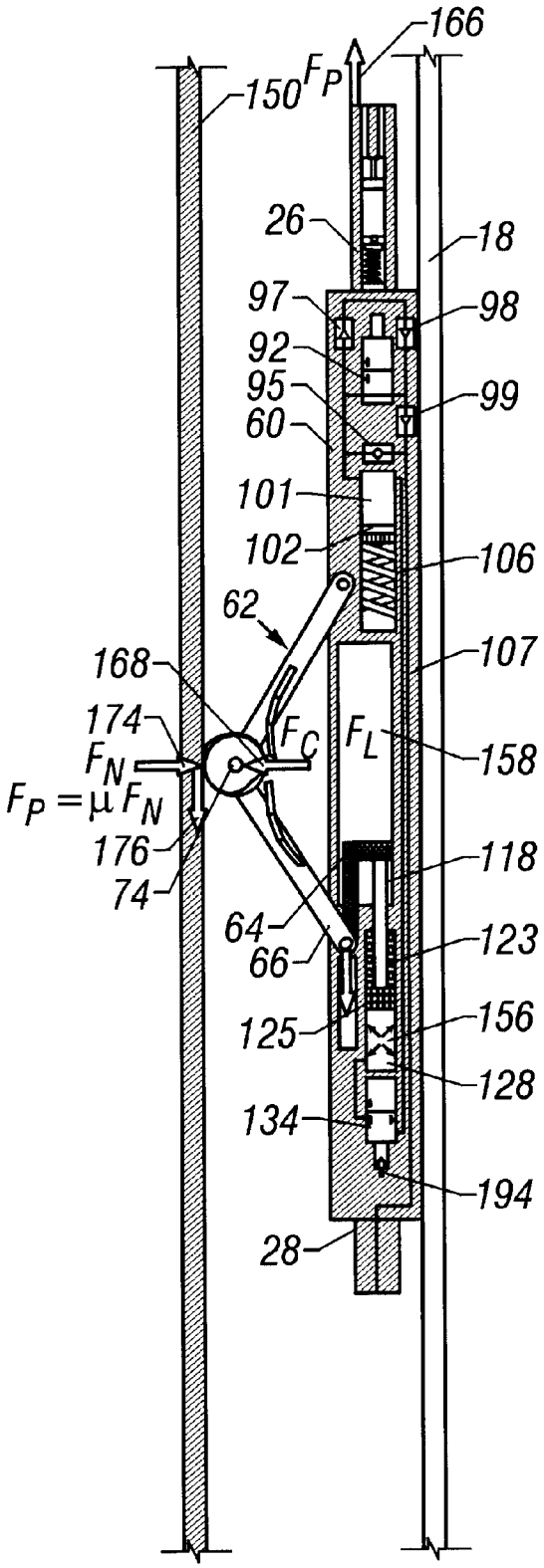

The gripping function of the grip 20 is shown n FIG. 11D. In this case, the drive rod exerts a pull force FP 166 in the upward direction, which is opposite to the direction of $F_R$ 160 in FIG. 11C. The solenoid valve 134 is now energized and closed, which is indicated by the arrow 194. By closing solenoid valve 134, the only passage out of chamber 128 is blocked and the fluid inside chamber 128 becomes trapped. Due to force $F_P$ 166, there is a tendency of the grip 20 to move upwards. This creates a friction force at the interface of the cam 70 and the well wall 150, which tends to rotate the cam 70 in such a way as to enlarge the distance between the wall 150 and axle 74. This process is the same as that described in FIG. 6A. The tendency of axle 74 to move to the right requires that hub 64 moves down. However, the movement of hub 64 and hence piston 125 downward is prevented by the fluid that is trapped in chamber 128. This makes the geometry of linkage 62 rigid, and prevents any further motion of axle 74. As explained in FIG. 6A these are the conditions that cause the cam 70 to grip the well wall 150 and to become anchored in place. Since cams 70 and, therefore, grip 20 cannot move with respect to the well wall, the whole tool is pulled with respect to the anchored grip by force $F_P$ 166. Anchored grip 20 and pulling of the whole tool with respect to the grip 20 are the events characteristic of the power stroke of the tool.

Figure 11E:
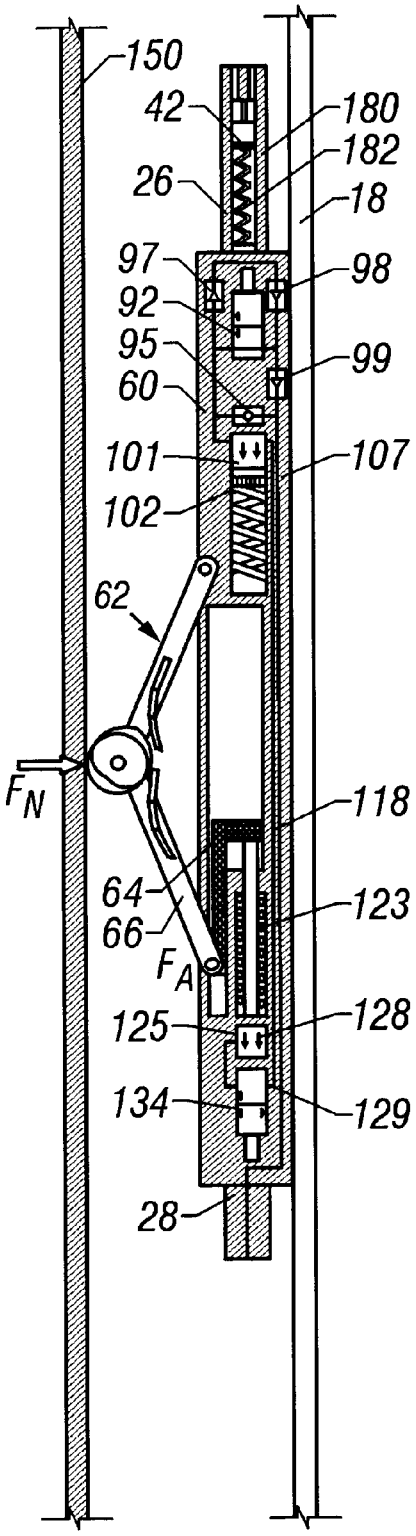

Finally, FIG. 11E describes the closing of linkages 62 back into the grip body 60 when power to solenoid valves 92 and 134 is shut off. In this case, both solenoid valves become open and fluid can flow freely through them. Spring 123 pushes piston 125 down, which results in closing linkages 62 into the grip body 60. The fluid from chamber 128 flows through solenoid valve 134 and then through passage 129 to chamber 101. In FIG. 11C, the fluid could not escape from chamber 101 because solenoid valve 92 was closed. Now solenoid valve 92 is open and the fluid from chamber 101 is pushed through it by spring 106. Next, the fluid passes through check valves 98 and 99 to the cocking piston chamber 180 and through passage 107 and rod 28 to the compensator (22__in FIG.__1). At the end of this process, the grip returns back to the position shown in FIG. 11A.

As indicated earlier, the hydraulic embodiment described in FIGS. 8–11 is only one possible construction of centralizing and locking devices. Another embodiment uses electromechanical devices as shown schematically in FIGS. 12A through 12C. One of the major elements of the electromechanical centralizing and locking devices is ball screw 200, which is supported by bearings 202 and 218 in the grip body 60. The ball screw 200 is powered by an electric motor 222. A first ball nut 210 and second ball nut 214 travel on the ball screw 200. The first ball nut 210 travels with hub 64. The first ball nut 210 can rotate with respect to the hub on bearings 208. The second ball nut 214 is attached to the carrier 216, which prevents rotation, but allows axial displacement with respect to the grip body 60. Other important elements are electromechanical brakes 206 and 220 and springs 204 and 212. Brake 206 selectively locks ball nut 210 with respect to hub 64. Brake 220 locks the ball screw 200 with respect to the grip body 60. Spring 204 is the closing spring and its action is similar to spring 123 in FIG. 8. Spring 212 provides the flexibility necessary for the centralization function of the invention and is functionally equivalent to spring 106 in FIG. 8.

Figures 12A, 12B, 12C:
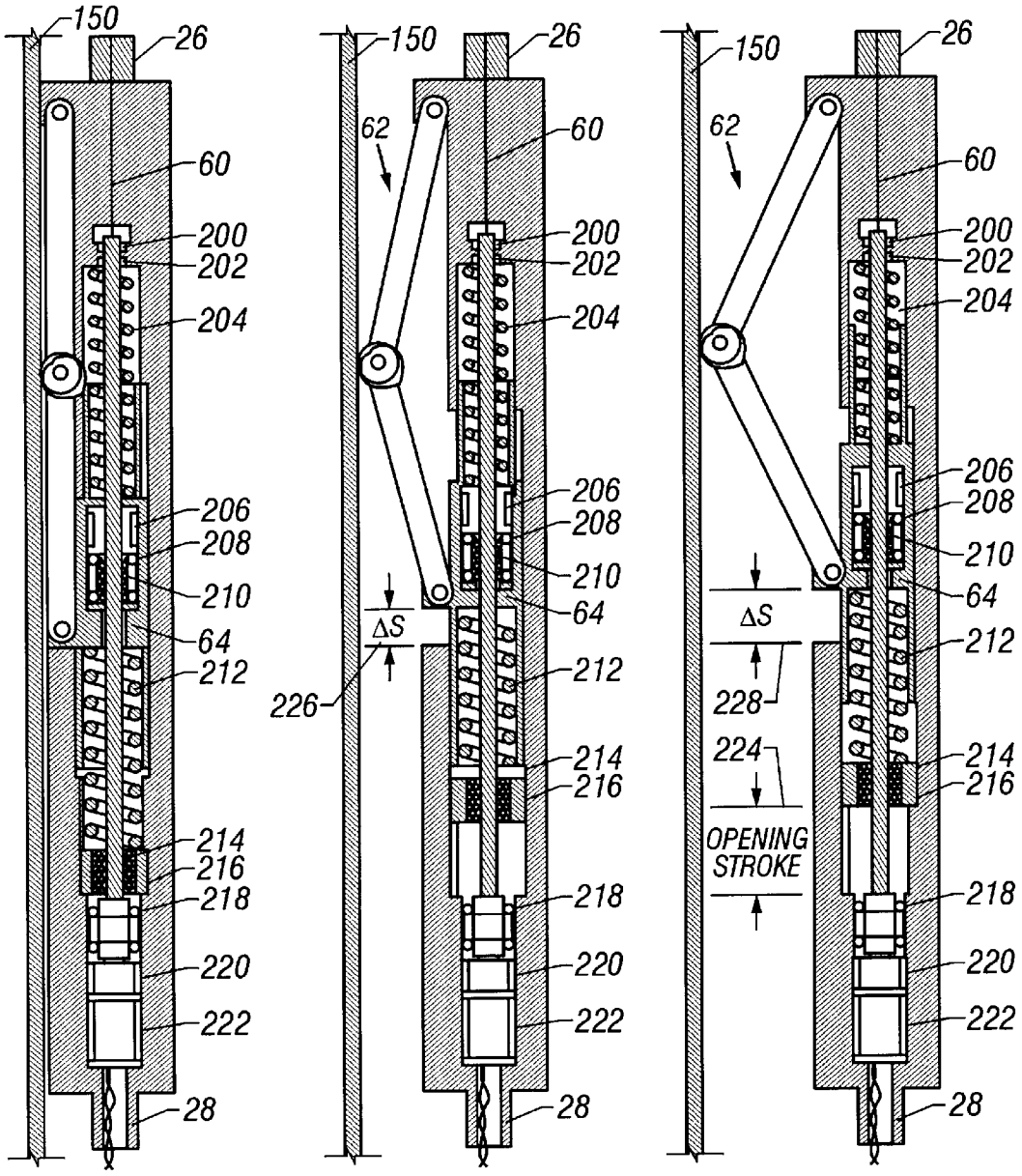
FIGS. 12A, 12B, and 12C are longitudinal cross-sectional views of an electro-mechanical embodiment of the invention that schematically show the major operational processes.

FIG. 12A shows the grip 20 in its non-powered state. The grip body 60 is in contact with the well wall 150. Both hub 64 and ball nut 214 are pushed all the way down by springs 204 and 212. FIG. 12A is functionally the same as FIG. 11A. FIG. 12B shows the centralizing section of the grip 20. The centralizing action begins by powering motor 222, which turns ball screw 200. Ball nut 214 is forced to travel upward until it reaches the position designated by "OPENING STROKE" 224 in FIG. 12C. At this point, the motor 222 is turned off and brake 220 is activated. Brake 220 prevents ball screw 200 from rotating and, hence, keeps ball nut 214 in a fixed position. This action is equivalent to the action of the cocking piston in FIG. 11B. Similarly, brake 220 performs the same function as solenoid valve 94 in FIG. 11B. FIGS. 12B and 12C demonstrate the capability of the invention to accommodate changes in the well bore diameter. This is possible through the action of spring 212, which either pushes hub 64 up in order to force linkages 64 further out or takes up the extra stroke when the grip goes through restrictions. In FIG. 12B and 12C, this is shown by the difference in displacements ΔS, designated by numbers 226 and 228.

The other major function of the grip, the capability to grip the well wall is provided by linkages 62 and by the capability of the grip to lock the position of hub 64 with respect to the grip body 60; the locking is achieved by brake 206. When activated, brake 206 prevents the rotation of ball nut 210 with respect to the ball screw 200. Since ball screw 200 cannot rotate due to the action of brake 220, the prevention of the rotation of ball nut 210 with respect to ball screw 200 is equivalent to locking the position of hub 64. After the geometry is locked, the gripping action of the cams is the same as that described in FIGS. 6A, 6B, and 6C.

Having explained the centralizing and locking functions of a grip according to the invention, it is now possible to explain the tractoring action of the whole tool, of which the grip is an essential part. As explained in FIGS. 11A and 12A, when the tractor tool is not operational, the arms and the cams of the grip are retracted into the grip body. When the tool is first powered, the centralizing function of the grip is activated. The grip arms extend from the grip body and position the tool at the center of the well. At this stage, the grip has the flexibility of a conventional biased-arm centralizer. The linkages automatically open or close to follow any variation in well bore size.

To begin tractoring, the linear actuator (16 in FIG. 1) is activated. It starts reciprocating the grip with respect to the sonde body. If the tool has to tractor in the downhole direction, the radial position of the linkages 62 is kept unlocked during the downward stroke of the linear actuator and is locked during the upward stroke. During the downward stroke, the cams automatically orient themselves (see FIG. 7) in such a way that they can slide freely downhole and grip if an attempt is made to move them uphole. Thus, during the downward stroke the grip is easily pushed downhole by the linear actuator. During the upward stroke, the the radial position of the linkages 62 is locked and, as explained in FIG. 11D, the linkages 62 form a rigid body that keeps the axles of cams at fixed radial positions. The attempt to move the grip uphole creates frictional forces between the cam surfaces and the well wall. These forces tend to rotate the cams on their axles. Since the axles' positions are fixed, the tendency of the cams to rotate creates very strong radial forces on the axles. These forces are passively reacted by the centralizer linkages and by the locking device. The high radial forces create sufficient frictional interaction between the grip and the well wall to anchor the grip in place. Thus, during the upward stroke, the grip is anchored to the well wall and the linear actuator pulls the rest of the tool with respect to the grip in the downward direction. At the end of the upward stroke, the the radial position of the linkages 62 is unlocked and the grip releases the well wall. The grip is free to be moved further downhole during the second downward stroke. The sequence of locking the the radial position of the linkages 62 during the upward stroke and unlocking it during the downward stroke is repeated, which results in an "inchworm-like" downward motion of the tractor tool. With the linear actuators of the two sondes moving in opposite directions, it is possible to convert the inchworm motion of each individual sonde into a continuous motion for the whole tool.

To reverse the tractor's direction of motion from downhole to uphole, it is only necessary to change the locking sequence of the grip solenoid valves in the hydraulic embodiment. If the grip is unlocked during the upward stroke and locked during the downward stroke, the whole tool will travel uphole. It is to be noted that during the first upward stroke, the cams automatically reorient themselves to grip in the proper direction, following the events shown in FIGS. 7A through 7H.

The tractoring is achieved by a "ratchet" action of the tractor. When moving in the downhole direction, there are two "strokes" that are combined to produce the motion. In the downward stroke, the grip is unlocked and moves downhole, while the rest of the device is stationary. In the upward stroke, the grip is locked and stationary relative to the hole, while the rest of the device is pulled downhole with the grip acting as an anchor to the hole wall. When moving in the uphole direction, the same two strokes are combined to produce the motion. In the downward stroke, the grip is locked and anchors to the hole wall, while the rest of the device moves uphole. In the upward stroke, the grip is unlocked and moves uphole, while the rest of the device remains stationary. In a first embodiment, there are two grips operating simultaneously in opposite cycles that allows one grip to always be anchored to the wall while the other grip is moving which allows for a simulated continuous movement of the device. In a second embodiment, one grip is provided that moves, and a secondary stationary grip is also provided. In this embodiment, when the movable grip is released and moved, the stationary grip is engaged to hold the device stationary relative to the wall of the hole. When the movable grip reaches the top of its stroke, the movable grip is anchored to the hole and the stationary grip is released so that the device can be pulled up or down the hole while the grip remains stationary. This provides a "inchworm-like" motion.

When tractoring is no longer needed, the linkages can be closed back into the grip body by the closing device.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A linkage apparatus for selectively gripping and releasing the inside walls of a conduit, the apparatus comprising:

a first arm;

a bi-directional gripping cam rotatably attached to the arm; and an extension and locking device adapted to selectively radially extend the arm from a tool housing to an inside wall of a conduit and adapted to selectively lock the arm in an extended position.

2. The linkage apparatus of claim 1 further comprising at least one wheel rotatably attached to the first arm, the wheel adjacent to the bi-directional gripping cam.

3. The linkage apparatus of claim 1 further comprising a biasing device adjacent to the first arm and the bi-directional gripping cam, the biasing device adapted to force the cam laterally towards the inside wall of the conduit.

4. The linkage apparatus of claim 1 wherein the cam has a constant contact angle.

5. The linkage apparatus of claim 1 further comprising a biasing device adapted to force the arm towards the inside wall of the conduit.

6. The apparatus of claim 1, further comprising a second arm having a first end and a second end, and wherein the first arm has a first end and a second end, and wherein the second end of the first arm is pivotably attached to the second end of the second arm.

7. An apparatus for selectively gripping and releasing the inside wall of a conduit, the apparatus comprising:

a plurality of linkages, each linkage comprising a first arm having a first end and a second end; a second arm having a first end and a second end, the second end of the first arm pivotably attached to the second end of the second arm, and a bi-directional gripping cam rotatably attached to at least one of the second end of the first arm and the second end of the second arm;

a grip body, the first end of the first arm pivotably attached to the grip body;

a hub, adapted to slide relative to the grip body, the first end of the second arm pivotably attached to the hub; and an extension and locking device adapted to selectively slide the hub so as to radially extend the linkages from the grip body and adapted to selectively lock the hub so that the linkages remain locked in an extended position.

8. The apparatus of claim 7 wherein the plurality of linkages each further comprises at least one wheel rotatably attached to at least one of the second end of the first arm and the second end of the second arm, wherein each wheel is adjacent to one of the bi-directional gripping cams.

9. The apparatus of claim 7 wherein the plurality of linkages each further comprises a biasing device adjacent to the bi-directional gripping cam, the biasing device adapted to force the cam laterally away from the grip body.

10. The apparatus of claim 7 wherein the extension and locking mechanism comprises an actuator rod having a first end and a second end, and a piston wherein the first end of the actuator rod is attached to the hub, and the second end of the actuator rod is attached to the piston, wherein the piston is adapted to move the actuator rod.

11. The apparatus of claim 10 further comprising a spring having a first end and a second end, wherein the first end of the spring is operatively coupled to the grip body, and the second end of the spring is operatively coupled to the piston, wherein the spring is adapted to exert a force on the piston, in a direction selected to force the plurality of linkages radially inward towards the grip body.

12. The apparatus of claim 11 further comprising a cylinder chamber, wherein the cylinder chamber encloses the piston and the spring.

13. The apparatus of claim 7 wherein the extension and locking device is adapted to automatically bias the linkages to a closed position upon a loss of electrical power.

14. The apparatus of claim 7 wherein the extension and locking device comprises a ball screw and a plurality of ball nuts operatively coupled to a motor.

15. The apparatus of claim 14 wherein the extension and locking device comprises a brake operatively coupled to the ball screw.

16. The apparatus of claim 7 wherein the extension and locking device comprises a source of high pressure fluid and at least one piston.

17. The apparatus of claim 16 wherein the extension and locking device is adapted to lock by selectively closing hydraulic communication to cylinder chambers enclosing each piston.

18. A method for conveying a tool body through a conduit, comprising:

(a) moving a bi-directional gripping cam into contact with an inner wall of a conduit;

(b) laterally locking a position of the cam; and (c) moving the tool body axially with respect to the cam in a first direction.

19. The method of claim 18 further comprising:

(d) releasing the lateral position of the cam;

(e) moving the cam axially along the inner wall of the conduit so as to reverse an orientation of the cam; and (f) relocking the lateral position of the cam and moving the tool body in a second direction.

20. The method of claim 18 further comprising:

(d) locking the axial position of the tool body;

(e) releasing the lateral position of the cam; and (f) moving the cam axially with respect to the tool body in the first direction.

21. The method of claim 20 wherein said (a) through (f) are repeated until the tool body has reached a predetermined location.

22. The method of claim 18 further comprising:

(d) moving a second bi-directional gripping cam axially with respect to the tool body and the first cam in the first direction;

(e) moving the second bi-directional gripping cam into contact with the inner wall of the conduit;

(f) laterally locking a position of the second cam;

(g) releasing the lateral position of the first cam;

(h) moving the first cam axially with respect to the tool body and the second cam in the first direction; and (i) moving the tool body axially with respect to the second cam in a first direction.

23. The method of claim 22 further comprising releasing the lateral position of the second cam, and wherein said (a) through (i) and said releasing the lateral position of the second cam are repeated until the tool body has reached a predetermined location.

* * * * *